US006024299A

United States Patent [19]

Drozkowski

[11] Patent Number: 6,024,299

[45] Date of Patent: Feb. 15, 2000

[54] APPLICATION HEAD FOR APPLYING AN INTERRUPTED BEAD OF MATERIAL

[75] Inventor: Edmund Drozkowski, Wisch, Germany

[73] Assignee: Rudolf von Bargen, Tespe, Germany

[21] Appl. No.: 09/056,113

[22] Filed: Apr. 6, 1998

[30] Foreign Application Priority Data

Apr. 4, 1997 [DE] Germany ..... 197 14 029

[51] Int. Cl.[7] ..... B05B 1/08

[52] U.S. Cl. ..... 239/290; 239/99; 239/581.1

[58] Field of Search ..... 239/99, 101, 574, 239/581.1, 583, 290, 418, 433, 424.5

[56] References Cited

U.S. PATENT DOCUMENTS 4,461,236 7/1984 Langenbach .
4,785,996 11/1988 Ziecker et al. ..... 239/298
5,056,687 10/1991 Claassen ..... 239/583 X
5,169,071 12/1992 Boger et al. ..... 239/296
5,740,963 4/1998 Riney et al. ..... 239/433 X

*Primary Examiner*—Andres Kashnikow
*Assistant Examiner*—Sean P. O'Hanlon
*Attorney, Agent, or Firm*—Harness, Dickey & Pierce, P.L.C.

[57] ABSTRACT

A device to apply liquid adhesive, especially hot-melt adhesive, to a length of material with the adhesive being interrupted includes an application head which has a control element with a pass-through channel and a rotatingly drivable control slide. The pass-through channel is connected to a supply channel for molten hot-melt adhesive at its entry end and to a nozzle aperture for the molten adhesive at its exit end. The control slide, in the course of a 360 degree rotation, opens and closes the pass-through channel at least once.

17 Claims, 5 Drawing Sheets

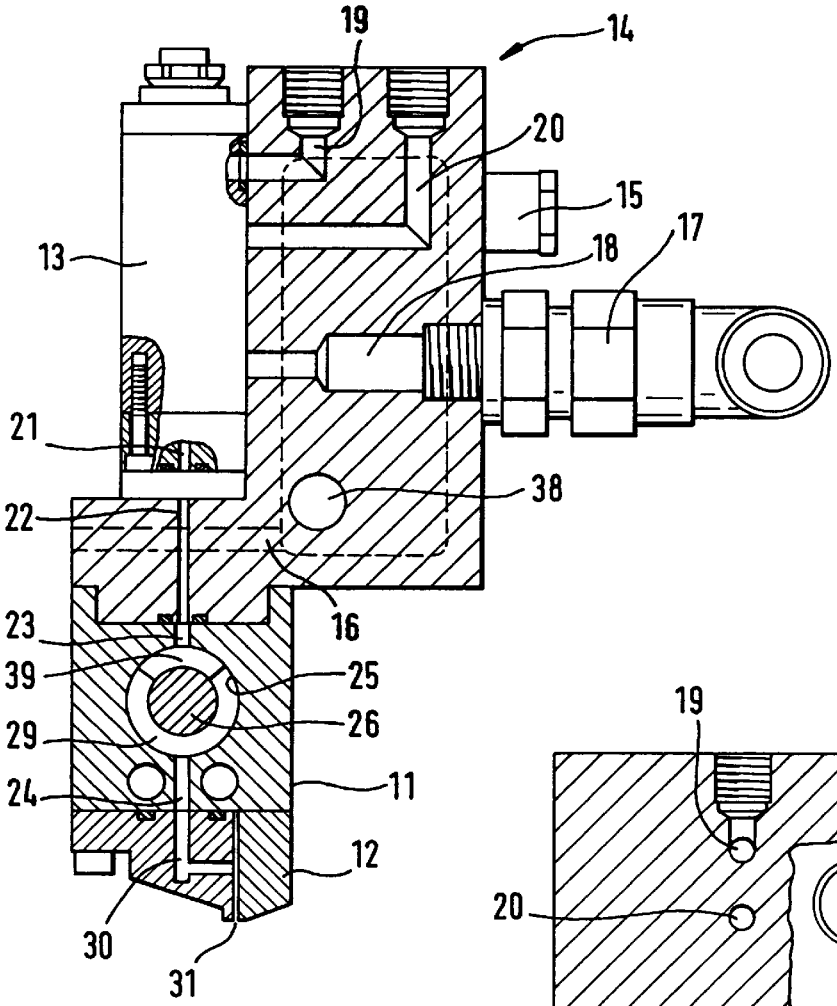
Fig. 2
Fig. 1
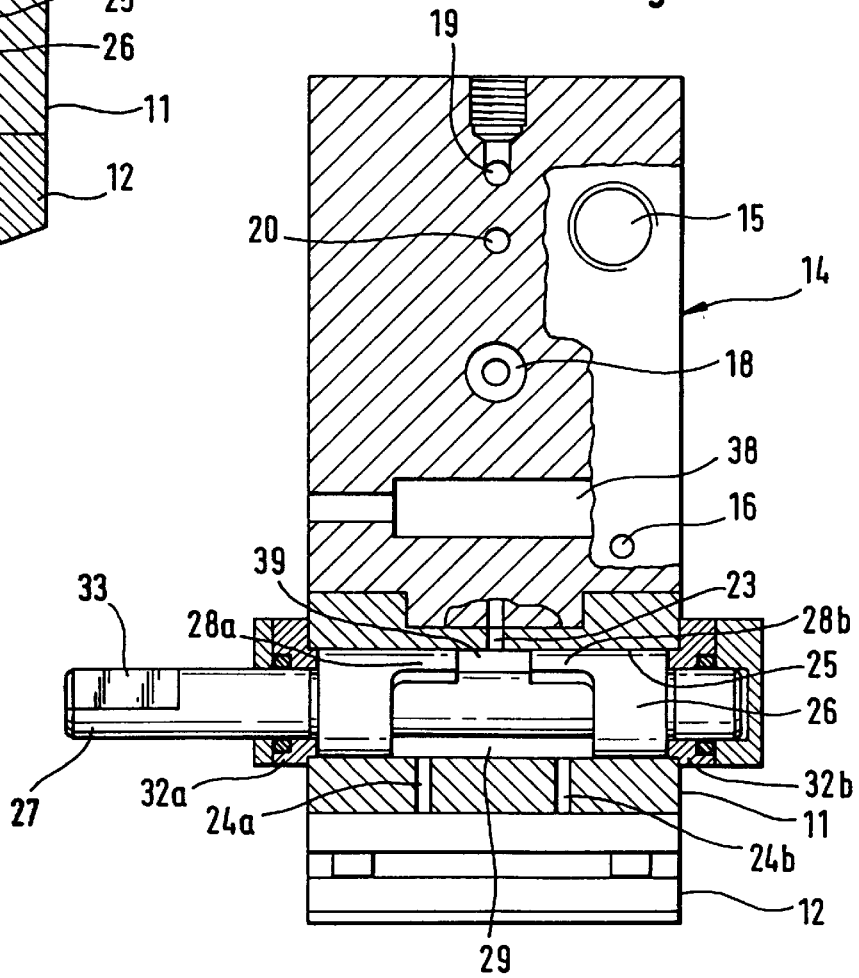

APPLICATION HEAD FOR APPLYING AN INTERRUPTED BEAD OF MATERIAL

BACKGROUND OF THE INVENTION

The invention relates to an application head for use in a device to apply liquid adhesive, especially hot-melt adhesive, to a length of material. The device permits intermittent application.

Applying molten hot-melt adhesive to lengths of material is common practice where the lengths of material are attached to a substrate. The adhesive is applied intermittently to keep the specific consumption of hot-melt adhesive low. The adhesive is applied by controllable adhesive nozzles. In order to apply the adhesive economically and uniformly, it is necessary to produce an application pattern which applies adhesive beads and interrupts the application over areas of a few millimeters. To reduce the amount of adhesive applied, by reducing the thickness of the strand of adhesive, has its limitations since the strand of adhesive may break or application may be irregular.

EP 0 474 155 A and EP 0 367 985 A2 describe application heads with a hole-type nozzle controlled by a pneumatically actuable nozzle needle. In the case of high material speeds, attempts to apply adhesive economically fail because these nozzle units cannot achieve the required cycle frequency. The cycle frequency is limited because of the mass inertia of the nozzle needle, the pneumatic cylinder and the pneumatic membrane, respectively. In addition, continuous control of the cycle frequency is often obstructed by natural oscillatory frequencies of the system.

SUMMARY OF THE INVENTION

It is therefore an object of the present invention to provide an application head which enables cycle frequency to be easily increased and which operates safely in all frequency ranges.

The solution includes a control element with a pass-through channel and a rotatingly drivable control slide. The pass-through channel, at its entry, is connected to a supply channel for molten hot-melt adhesive. At the exit end of the pass-through channel, the channel is connected to a nozzle aperture for the molten adhesive. The control slide, in the course of its 360 degree rotation, opens and closes the pass-through channel at least once.

Pressure is generated, in the usual way, in the supply line for the molten hot-melt adhesive. The supply of adhesive is directly controlled in front of the adhesive nozzle by a control slide. The control slide is a rotary slide. The rotational speed of the rotary slide can easily be increased to high speed levels. Thus, the cycle frequency for the outflow of the adhesive may be increased to any value. Since the size of the control means has been reduced to a minimum, vibration problems at the rotary slide can be eliminated altogether even at high speeds. A shut-off valve is provided directly in front of the control unit to prevent any adhesive from flowing out of the adhesive nozzle when switching off the device. Preferably, a pneumatically actuable shut-off valve is used. Also, in this embodiment, the shut-off valve does not fulfil any function with respect to metering the hot-melt adhesive.

According to a first embodiment, the control slide is a rotary roller-type slide. A pass-through channel extends substantially radially relative to the cylindrical slide chamber of the rotary roller-type slide. The entry portion and the exit portion of the pass-through-channel may be offset along the axis of the slide chamber. Thus, with proper rotary roller-type slide design, the inflow to the slide chamber is permanently open. Accordingly, at the same time, a uniform pre-pressure is ensured in the slide chamber. The outflow from the slide chamber is opened and closed in cycles. The exit portion of the pass-through channel can be designed to be multi-fluted.

According to a second embodiment, the control slide is a plate-type rotary slide. A pass-through channel, while being offset in parallel to the channel axis, ends in the end faces of the slide chamber. Also, in this embodiment, by proper control slide design, the inflow into the slide chamber may remain permanently open. The outflow from the slide chamber is controlled in cycles.

As a rule, a bead of adhesive and an interruption in the flow of adhesive are achieved by rotating the rotary slide by 360 degrees. However, by proper rotary slide design, it is possible to produce several beads of adhesive of different lengths.

If the exit ends of the pass-through channels are multi-fluted, it is possible, by means of one single rotary slide, to produce several beads of adhesive on a length of material. The beads may be displaced relative to one another with respect to their cycle.

The rotational speed of the rotary slide can be set by an electronic drive to reach a certain ratio relative to the rotational speed of the main shaft of the complete application device. The rotation of the main shaft of the complete machine determines the cycle. The phase position can be changed by a phase setting drive in the drive of the application head control slide.

To achieve different application patterns, the control shaft is accelerated and decelerated in a controlled manner while it is rotating. Thus, it is possible to vary the ratio between the application of adhesive and the interruption in the application of adhesive without the need to exchange the application head or the control shaft.

Normally, a plurality of inventive nozzles is arranged on a common carrier beam transversely to the conveying direction of the length of material. The control slides of the inventive nozzles are connected to one another or are arranged on a common control slide shaft. In this embodiment, each nozzle unit includes a plurality of hole-type nozzle exits or slotted nozzle exits. In a preferred embodiment, a mask is inserted into one nozzle slot. The mask releases individual slot regions and closes other slot regions. Nozzle units of this type may be combined with compressed air exits in the region of the nozzle holes in order to whirl an adhesive thread or to twist a spiral-shaped length of adhesive. Also, the adhesive film may be deflected to apply the adhesive film in a planar way on to the length of material. The nozzle aperture and the length of material are arranged in a contact-free way. The emerging compressed air can be preheated to prevent early setting of the liquid adhesive.

The present inventive application head provides a device which enables an accurately metered quantity of adhesive to be applied intermittently, even if the length of material moves at high speeds. The device has a simple design.

From the following detailed description, taken in conjunction with the drawings and subjoined claims, other objects and advantages of the present invention will become apparent to those skilled in the art.

BRIEF DESCRIPTION OF THE DRAWINGS

Further details are given in the description of the attached drawings.

FIG. 1 is a cross-section view of an application head with a roller-type control slide through the slide axis.

FIG. 2 is a cross-section view of FIG. 1 in a vertical section extending perpendicularly relative to the slide axis.

DETAILED DESCRIPTION OF THE PREFERRED EMBODIMENT

Figure 2A:
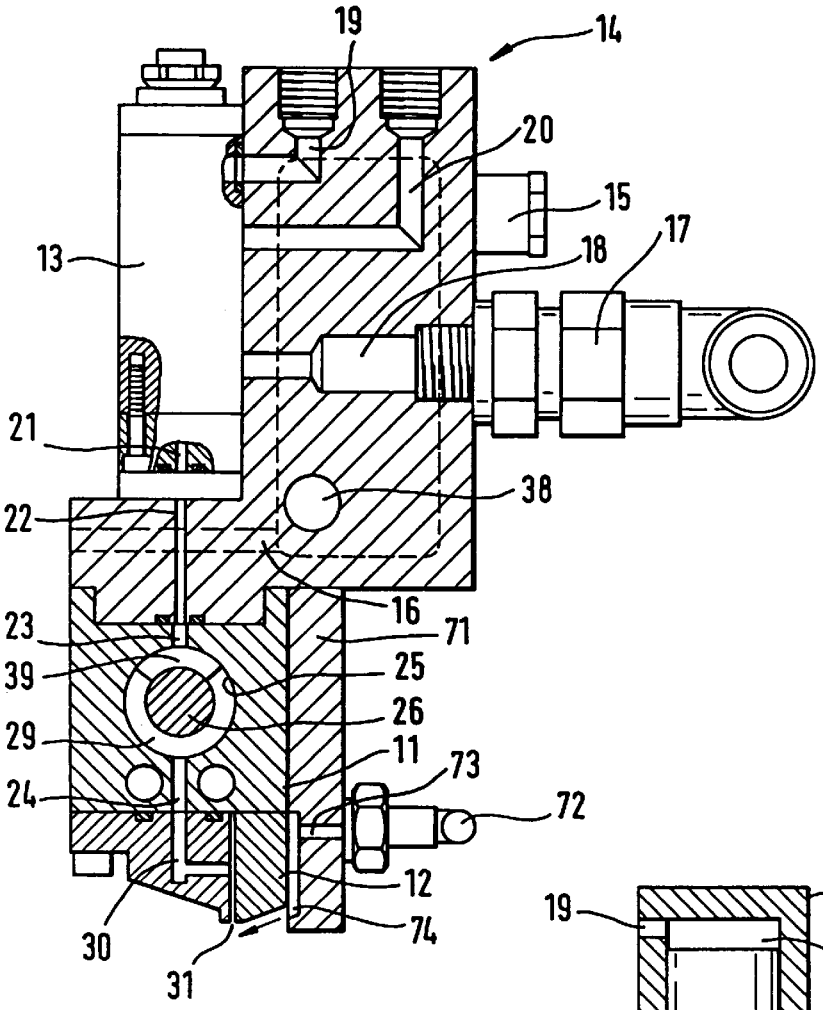
FIG. 2*a* is a view like FIG. 2 of another embodiment of the present invention.

FIGS. 1 and 2 will be described jointly below. The application head has several housing parts. As far as details are concerned, the head includes a control block 11, a nozzle block 12, a valve block 13, and a carrier block 14. The carrier block 14 has a cable passage 15 for a connecting cable of a heating cartridge or a thermo-sensor. A receiving bore 16 receives a thermo-sensor and a receiving bore 38 receives a heating cartridge. Suitable bolting and clamping means (not illustrated) secure the carrier block to the complete device.

A threaded sleeve 17 connects a hot-melt adhesive supply pipe which supplies an adhesive channel 18. The adhesive channel 18 is guided into the valve block 13. The carrier block 14 is provided with a first compressed air channel 19 and with a second compressed air channel 20. The channels 19, 20 are also guided into the valve block 13.

The valve block 13 includes portion 21 of an adhesive channel. The portion 21 continues into an adhesive channel 22 in the carrier block 14.

The adhesive channel 22 ends in an inlet portion 23 of a pass-through channel in the control block 11. The adhesive channel 22 leaves the control block 11 in an exit portion 24 of the through-channel. The exit portion has two parallel arms 24*a*, 24*b*. The pass-through channel radially extends through a cylindrical slide chamber 25.

A roller-type control slide 26 moves within the chamber 25. The control slide 26 is integral with a control shaft 27. The roller-type control slide 26 includes a 360 degree recess 39. The recess 39 is associated with the entry portion 23 to ensure a constant supply of adhesive into the slide chamber 25. In the region of the two arms 24*a*, 24*b* of the exit portion, the roller-type control slide 26 includes a recess 29 extending over 270 degrees and land regions 28*a*, 28*b* extending over 90 degrees. The exit portion 24 is followed by a nozzle bore 30 which ends in a slotted nozzle 31. Masks may be inserted into the slotted nozzle 31. The masks leave open and close, respectively, individual slot portions. The control shaft 27 is supported in covers 32*a*, 32*b* and, at one exit end, has a key face 33 for rotational driving purposes.

FIG. 2*a* is a view like FIG. 2. The elements which are the same are designated with the same reference numerals. Here, the difference is an airduct block 71 connected to an airline 72. Also, a supply bore 73 and a compressed air exit slot 74 are within the airduct block 71.

Figure 3:
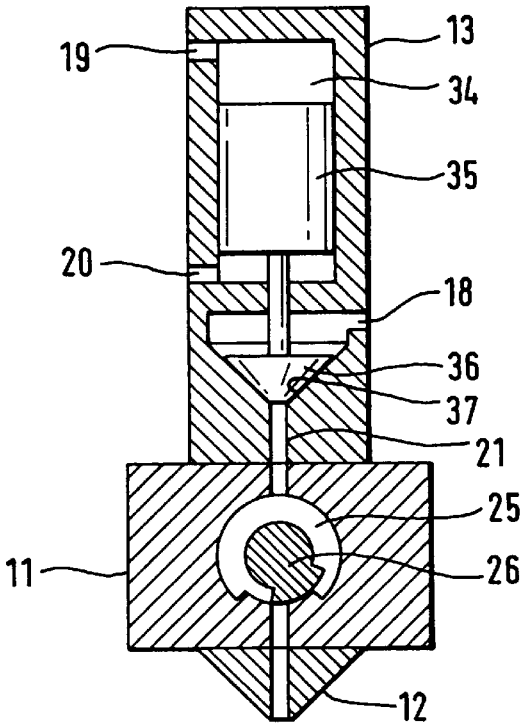
FIG. 3 is a cross-section view of the application head with a roller-type control slide extending perpendicularly relative to the slide axis.

FIG. 3 shows the valve block 13, the control block 11 and the nozzle block 12 in a simplified illustration. The details in FIG. 3 which correspond to those in FIGS. 1 and 2 have been given the same reference numbers. A piston chamber 34 with a pneumatic piston 35 is shown inside the valve block 13. The piston 35 moves a valve plate 36. The valve plate 36 is positioned on a conical valve seat 37. The valve plate 36 is able to block the supply of adhesive through the adhesive channel 18 and the adhesive discharge through the adhesive channel 21. The valve plate 36 is shown on the valve seat 37 in the blocking position. The blocking position is effected by applying compressed air through the first compressed air channel 19. At this time, the second compressed air channel 20 remains pressure-less.

Figure 4A:
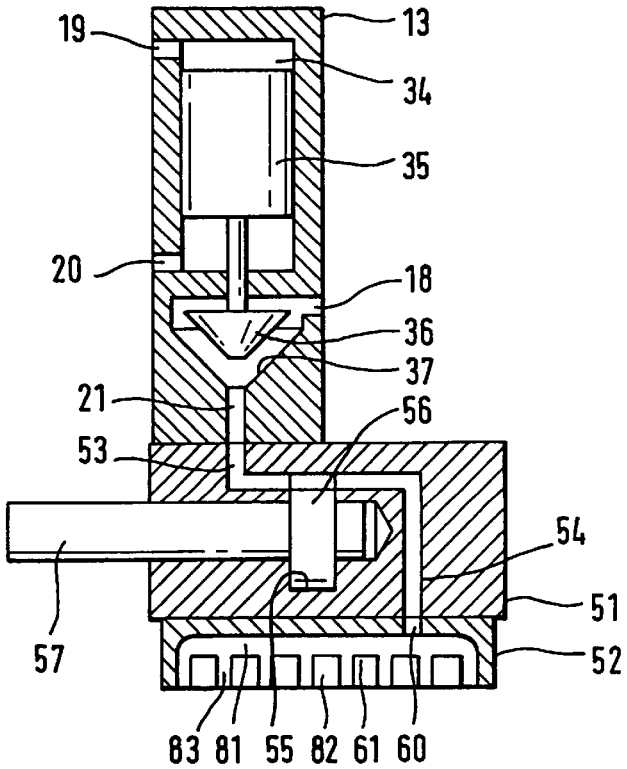
FIG. 4*a* is a view like FIG. 4 of another embodiment of the present invention.
Figure 4:
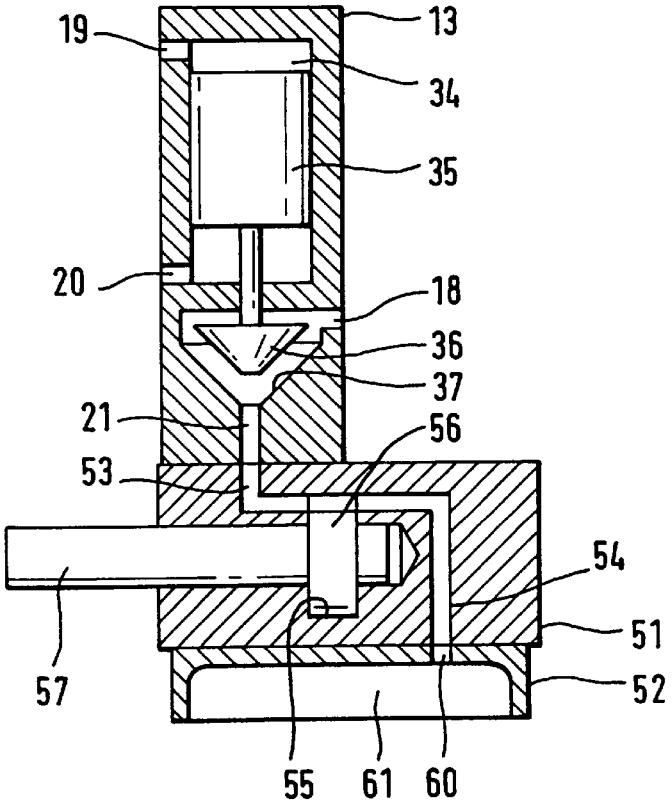
FIG. 4 is a cross-section view of an application head with a plate-type control slide through the slide axis.

FIG. 4 shows the valve block 13 in the same manner as illustrated in FIG. 3, with a control block 51 and a nozzle block 52. However, in this case, the valve plate 36 is lifted off the valve seat 37. Thus, the valve plate 36 releases the flow of adhesive from the adhesive channel 18 to the adhesive channel 21. The valve plate 36 is shown in an open position. The open position is effected by applying compressed air through the second compressed air channel 20. The modified control block 51 includes an entry portion 53 of the pass-through channel and an exit portion 54 of the pass-through channel. The portions 53, 54, in an axis-parallel way, while being offset relative to the axis of the plate-type control slide 56, enter a slide chamber 55. The plate-type control slide 56 is able to close the passage by means of its end faces. The plate-type control slide 56 is positioned on a shaft 57 for rotary drive. The shaft 57 projects only at one end from the control block 51. In the illustration of the nozzle block 52, a nozzle bore 60 passes into a nozzle provided in the form of a slotted nozzle 61.

FIG. 4*a* is a view like FIG. 4. The elements which are the same are designated with the same reference numerals. Here, the difference is that a mask is inserted within the slotted nozzle 52. The mask includes a traverse air supply groove 81, lands 82 and a plurality of individual slots 83.

Those details in FIGS. 5*a*–5*d* which correspond to those in FIG. 3 have been given the same reference numbers.

Figure 5C:
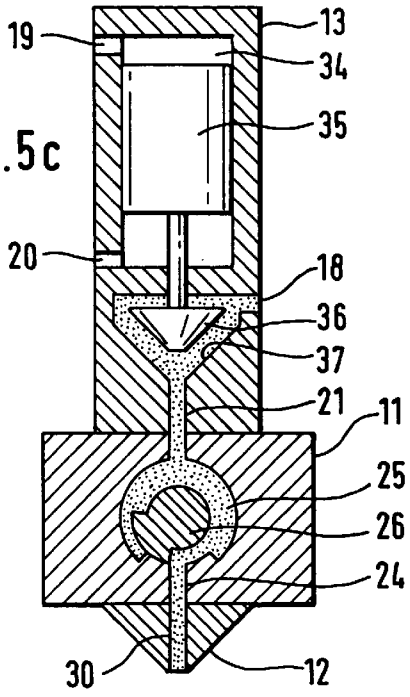
FIGS. 5*a*–5*c* are cross-section views like FIG. 3 in the position according to FIG. 3, in a second position, and in a third position, respectively.
Figure 5B:
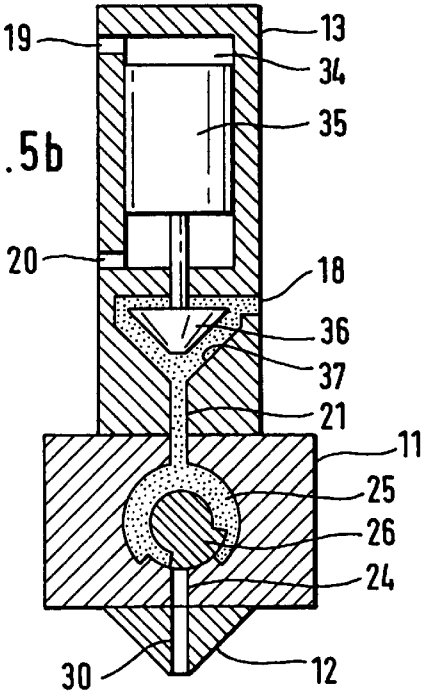
Figure 5A:
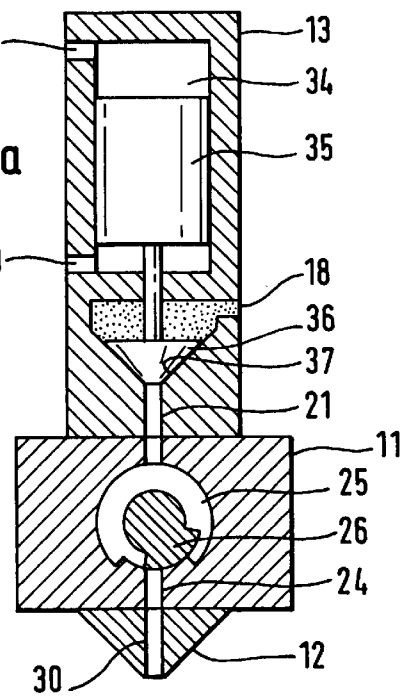

FIG. 5*a* shows the valve plate 36 in the valve block 13 in a position which blocks the flow of adhesive from the adhesive channel 18 to the adhesive channel 21. FIG. 5*a* also shows the control slide 26 in the control block 11 in a position which blocks the flow of adhesive from the slide chamber 25 into the exit portion 24 of the through-flow aperture.

In FIG. 5*b*, the piston 35 is lifted due to the application of compressed air. Thus, the valve plate 36 is lifted off the valve seat 37. The control slide 26 is in the same position as shown in FIG. 5*a*. Accordingly, the slide 26 blocks the flow of adhesive to the exit portion 24 of the through-flow aperture.

In FIG. 5*c*, the piston 35 is in the same position as in FIG. 5*b*. Thus, free flow of adhesive is present from the adhesive channel 18 to the adhesive channel 21. The roller-type control slide 26 is rotated clockwise by 90 degrees. As a result, the adhesive is free to flow from the slide chamber 25 into the exit portion 24 of the pass-through channel. Adhesive is able to enter the nozzle bore 30 of the nozzle block 12.

Figure 5D:
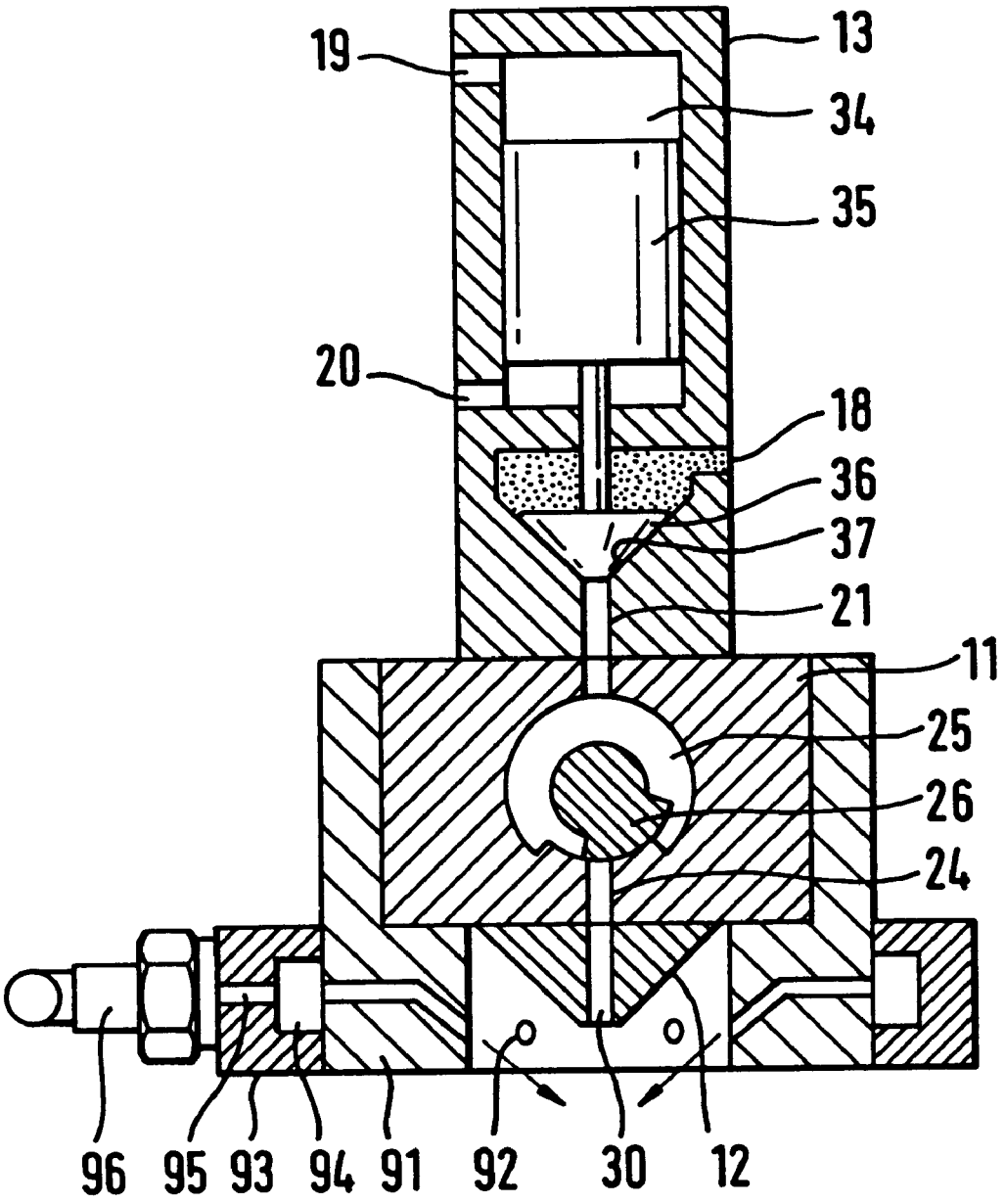
FIG. 5*d* is a view like FIG. 5*a* of another embodiment of the present invention.

FIG. 5*d* is a view like FIG. 5*a*. The elements which are the same are designated with the same reference numerals. Here, the difference is an air block 91 coupled with the control block 11. The air block 91 has a plurality of compressed air exit apertures 92. The air exit apertures 92 are supplied with compressed air via a supply ring 93. The supply ring 93 has a ring channel 94 and a supply bore 95. The supply bore 95 is connected to a compressed air supply line 96.

Figure 6:
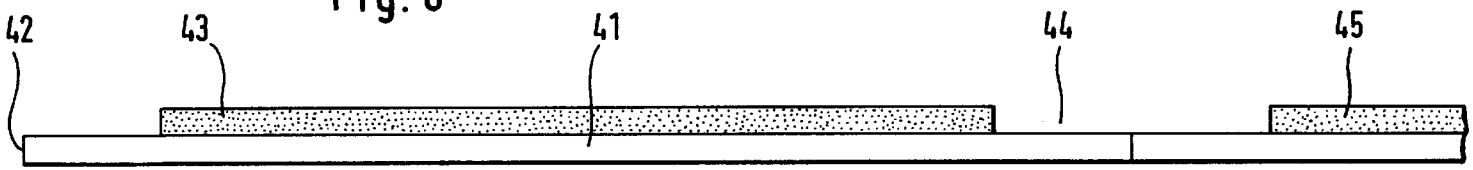
FIG. 6 is a longitudinal section view through a length of material with an intermittently applied adhesive.

FIG. 6 shows a length of material 41. On the left of the material 41 is a cut edge 42. On the right of the material 41 it is shown as broken. At a small distance from the cut edge 42, a bead of adhesive 43 is applied which has a finite length. This is followed by an adhesive-free region 44 which, in turn, is followed by a further bead of adhesive 45. If the length of material 42 is to be divided by cutting, such cuts must be effected in the adhesive interrupted regions. This prevents the blades from becoming sticky and from smudging. The ratio of the length of a bead of adhesive 43 to the adhesive-free region 44 is 3:1. This ratio is achieved by a control slide according to FIG. 5. Here, the land 28 covers 90 degrees and the respective recess 29 270 degrees.

While the above detailed description describes the preferred embodiment of the present invention, the invention is susceptible to modification, variation and alteration without deviating from the scope and fair meaning of the subjoined claims.

What is claimed is:

1. An application head for applying liquid adhesive, being hot-melt adhesive, to a length of material with the adhesive being interrupted, comprising:

an application head, a control element with a pass-through channel; and a rotatingly drivable control slide;

said pass-through channel at an entry end being connected to a supply channel for molten hot-melt adhesive and at an exit end of said pass-through channel being connected to a nozzle aperture for the molten adhesive;

and said control slide in the course of a 360 degree rotation, opening and closing said pass-through channel at least once for providing an interrupted bead of adhesive.

2. An application head according to claim 1, wherein the control element comprises a control block which rotatably supports the control slide by a portion of a control shaft in said control block.

3. An application head according to claim 2, wherein the control block at said entry end is connected to a carrier-block.

4. An application head according to claim 2, wherein the control block, at said exit end is connected to a nozzle block.

5. An application head according to claim 4, wherein the nozzle block comprises one or several hole-type nozzles.

6. An application head according to claim 5, wherein around each exit aperture of a hole-type nozzle, a plurality of compressed air exit apertures is arranged aligned on the axis of said nozzle exit aperture, with the compressed air which leaves the compressed air exit apertures deflecting the liquid adhesive leaving the exit aperture of the hole-type nozzles in such a way that it forms a spiral-like thread.

7. An application head according to claim 4, wherein the nozzle block comprises a slotted nozzle.

8. An application head according to claim 7, wherein a mask is inserted into the slot of the slotted nozzle for producing a plurality of individual holes or individual slots.

9. An application head according to claim 7, wherein parallel to each slotted nozzle aperture, a compressed air exit slot is arranged which is inclined relative to the said slotted nozzle aperture, with the compressed air, being heated compressed air, leaving the compressed air exit slot deflecting the liquid adhesive which leaves the slotted nozzle aperture in such a way that it forms a film to be applied in a planar way, with no contact between the nozzle block and the length of material.

10. An application head according to claim 1, wherein said control slide comprises cylindrical blocking portions and releasing recesses and is held in a cylindrical chamber.

11. An application head according to claim 10, wherein said pass-through channel at said entrance end and at said exit end extends radially relative to the cylindrical chamber and that the cylindrical surface of the blocking portion causes the pass-through channel to be blocked.

12. An application head according to claim 10, wherein said pass-through channel at said entry end and at said exit end extends so as to be axis-parallel to the cylindrical chamber and said radial end faces of the blocking portion of the control slide cause the pass-through channel to be blocked.

13. An application head according to claim 10, wherein the control slide is provided with a releasing recess which is effective over an angle of rotation of 360 degrees and which is associated with the entry portion of the pass-through channel.

14. An application head according to claim 1, wherein a valve block comprises a pneumatically actuable shut-off valve coupled with said valve block.

15. An application head according to claim 1, wherein said pass-through channel at said entry end or at said exit end includes a plurality of arms.

16. An application head according to claim 15, wherein said control slide comprises lands with different shapes for different arms of the exit portion of the pass-through channel.

17. A method of controlling an application head according to claim 1, comprising:

accelerating or decelerating the control element;

controlling the control shaft during rotation; and achieving different interrupted application patterns due to different acceleration or deceleration patterns.

* * * * *